US007226139B2

(12) United States Patent
Salice

(10) Patent No.: US 7,226,139 B2
(45) Date of Patent: Jun. 5, 2007

(54) DEVICE FOR ADJUSTING THE HEIGHT OF A DRAWER

(75) Inventor: Luciano Salice, Carimate (IT)

(73) Assignee: Arturo Salice S.p.A., Novedrate (Como) (IT)

( * ) Notice: Subject to any disclaimer, the term of this patent is extended or adjusted under 35 U.S.C. 154(b) by 279 days.

(21) Appl. No.: 10/463,534

(22) Filed: Jun. 18, 2003

(65) Prior Publication Data

US 2003/0234603 A1 Dec. 25, 2003

(30) Foreign Application Priority Data

Jun. 19, 2002 (DE) ..... 202 09 517 U
Jul. 31, 2002 (DE) ..... 202 11 803 U

(51) Int. Cl.
*A47B 88/00* (2006.01)

(52) U.S. Cl. ..... 312/334.4; 312/330.1

(58) Field of Classification Search ..... 312/330.1, 312/333, 334.1, 334.4, 334.5, 334.7, 334.8, 312/334.27, 334.6, 334.14
See application file for complete search history.

(56) References Cited

U.S. PATENT DOCUMENTS

| | | | | |
|---|---|---|---|---|
| 549,283 | A | 11/1895 | Wendte | |
| 4,810,045 | A * | 3/1989 | Lautenschlager | 312/334.5 |
| 5,375,922 | A | 12/1994 | Brüstle et al. | 312/334.4 |
| 5,439,283 | A * | 8/1995 | Schroder et al. | 312/334.4 |
| 5,580,139 | A * | 12/1996 | Grabher | 312/333 |
| 5,588,729 | A | 12/1996 | Berger | 312/334.4 |
| 5,664,855 | A | 9/1997 | Lautenschlager | 312/334.4 |
| 6,913,334 | B2 * | 7/2005 | Weichelt | 312/334.4 |

FOREIGN PATENT DOCUMENTS

| | | |
|---|---|---|
| AT | 0400660 | 2/1996 |
| AT | 0402598 | 6/1997 |
| DE | 8228143 | 1/1983 |
| DE | 3939257 | 6/1990 |
| DE | 4114708 | * 11/1992 |
| DE | 9215337 | 4/1993 |
| DE | 9300260 | 4/1993 |
| DE | 9304521 | * 7/1993 |
| DE | 43 01 327 | 8/1993 |
| DE | 93 18 383.6 | 3/1994 |
| DE | 93 20 197.4 | 6/1994 |
| DE | 44 14 462 | 11/1995 |
| DE | 4432820 | 3/1996 |
| DE | 296 00 180 | 4/1996 |
| DE | 20107278 | 9/2001 |
| EP | 0 545 329 | 6/1993 |
| EP | 0606564 | 7/1994 |
| EP | 0 701 787 | 8/1995 |
| EP | 0761132 | 3/1997 |

* cited by examiner

*Primary Examiner*—James O. Hansen
(74) *Attorney, Agent, or Firm*—Jacobson Holman PLLC

(57) ABSTRACT

A device for adjusting the height of a drawer, which, by way of a draw-out guide connected to the drawer on the side thereof, is guided by means of draw-out rails on supporting rails on the carcass side. The device includes an adjustment device by means of which the drawer is raiseable and lowerable relative to the supporting rails. On the draw-out rails of the draw-out guide, and at right angles to these, sliders are guided in guides, with the sliders including supports for the underside or the bottom of the drawer. The sliders are movable in height by way of the adjustment device.

35 Claims, 12 Drawing Sheets

DEVICE FOR ADJUSTING THE HEIGHT OF A DRAWER

BACKGROUND OF THE INVENTION

1. Field of the Invention

The invention relates to a device for adjusting the height of a drawer, which, by way of a draw-out guide connected to said drawer on the side of said drawer, is guided by means of draw-out rails on supporting rails on the carcass side; comprising an adjustment device by means of which the drawer is raiseable relative to the supporting rails and is lowerable down to the plane of the top of the draw-out guide.

2. Description of the Related Art

Draw-out guides for drawers with draw-out rails on the drawer side and supporting rails on the carcass side are known in various embodiments. In this type of draw-out guide it is necessary to align the front sidewalls or front panels of the drawers relative to each other, and if necessary in relation to the doors or flaps of a piece of furniture, so that the size of the gaps or dimensions between these is the same. Due to unavoidable manufacturing tolerances, it is necessary to design the fronts or front panels of the drawers so as to be height-adjustable in order to be able to set the desired spacings to other parts of the piece of furniture. From DE 44 14 462 A1, a device of the type mentioned in the introduction is known, which comprises fittings for height-adjustable holding of drawers on these running rails of drawers which are supported at the bottom, in which a sliding piece which comprises a placement area pointing towards the bottom of the drawer is slidably arranged, at the running rail of the respective draw-out guide, by way of specified adjustment travel and parallel to the running rails, but in relation to draw-out direction of the drawer at such an incline that the placement area of the sliding piece in the one horizontal slide-end position is essentially flush with or even below the underside of the bottom of the drawer if the drawer in the proper installation position is supported on the running rail, while by contrast, in the other slide-end position, it is upward off-set by the desired height adjustment dimension.

SUMMARY OF THE INVENTION

It is the object of the invention to create a device of the type mentioned in the introduction, which device is easy to produce and in particular is easy to handle.

According to the invention, this object is met in that at the draw-out rails of the draw-out guide, sliders are guided, in guides, at right angles to said draw-out rails of the draw-out guide, with said sliders comprising support surfaces for the underside or the bottom of the drawer, and in that the sliders are movable in height by means of the adjustment device.

A preferred embodiment provides for each slider to comprise a multiple-angled sheet metal part or structural part which with a hook or an upwards jutting projection engages a borehole in each of the drawer side parts, and that the sheet metal part or structural part comprises a section which rests against the inner vertical web of the draw-out rail, both of which, for mutual guidance, comprise vertical slots or grooves and knobs or projections engaging said vertical slots or grooves. At its end which is positioned in front in the direction of pushing in, each draw-out rail can comprise a hook, which for connecting the draw-out rail to the drawer engages a recess or borehole in the front of the drawer. The projection or hook provided according to the invention prevents horizontal displacement of the drawer relative to the draw-out rails so that as a result of the sliding movement of the drawer said drawer does not become detached from the draw-out rails. The device according to the invention provides a particular advantage in that the slider can comprise devices for holding the drawer in its front region.

Preferably, the adjustment device comprises an eccentric whose shaft is rotatably connected to the vertical web of the draw-out rail or to the section resting against said draw-out rail, with the eccentric disc being located in a horizontal elongated hole in the supported section, with the section lapping the elongated hole by means of a widened head. Adjustment devices for adjusting the height of drawers, which adjustment devices comprise cam bodies or eccentrics, are for example known from DE-GM 82 28 143.2 and 93 18 383.6 as well as from EP 0 545 329 A2.

Expediently, the shaft of the eccentric is kept in a borehole in the inner vertical web part of the U-shaped draw-out rail by way of a rivet head.

Each U-shaped draw-out rail with a running surface which is angled away from its inner limb can comprise, adjacent to its inner vertical limb, a recess in its web part and its outer limb, into which recess each slider with sections that are angled away according to the recess is fitted.

A modified embodiment provides for each slider to comprise an angular piece whose upper horizontal limb supports the bottom of the drawer in its extended position, and for the vertical limb of said angular piece to rest against the inner web or limb of the draw-out rail, and to be guided by said web or limb so as to be height-adjustable. In this arrangement, the horizontal limb of the angular piece can lap the associated draw-out rail or it can be angled so as to point away from said draw-out rail. Expediently, in this embodiment, by way of a free cut, a latch is bent out of each outer vertical web of each draw-out rail, with the upwards jutting section of said latch engaging a borehole in each of the drawer side parts, so that the drawer is non-slidably held in horizontal direction, relative to the draw-out rail.

According to a further embodiment of the invention, the object is met in that an adjustment device each is arranged at supporting pieces, which are connected or interlocked with the front end region of the draw-out rails, which face the front wall or panel of the drawer, and in that the supporting pieces comprise devices for holding the drawer.

Preferably, a supporting part is connected to each draw-out rail, with a guide section for the slider jutting out over said supporting part, in the direction of the front drawer panel, wherein the guide section and the slider comprise guide devices which extend transversely to the draw-out rail, and further comprise an adjustment device. By means of this embodiment, a device for height adjusting the drawer can be created which, without special adaptation of the draw-out rail, only needs to be connected with said draw-out rail.

Expediently, the guide pieces comprise vertical grooves, and knobs or webs which engage said vertical grooves. The adjustment device in turn can comprise an eccentric of the type already stated.

In a further embodiment of the invention, for simple attachment of the supporting part to the draw-out rail, the supporting part comprises a right-angled pin which is non-rotatably held in boreholes of the front and rear vertical webs or limbs of the draw-out rail.

A step on the guide section of the supporting part can rest against the front vertical edge of the inner web part or limb of the guide rail.

Advantageously, the slider comprises a sheet metal piece or structural part which is bent so as to be U-shaped, with the web part of said metal piece or structural part being able to be raised from a position which is flush with the web part of the U-shaped draw-out rail. From the outer limb of the slider, an extended part can be bent away in a U-shape, with the upwards jutting limb of said extended part engaging a borehole in a side part of the drawer, in this way preventing the drawer from moving in horizontal direction relative to the draw-out rail.

The front limb of the slider can comprise a bent-away sprung extended part which comprises an angled-off latch which engages a recess in the front panel and/or in a sidewall of the drawer.

During adjustment of the slider, the extended parts with the latches which point away at an angle are moved together with said extended parts and the drawer, so that the corresponding recesses at the front panel and/or sidewall of the drawer can be made smaller, thus ensuring a better hold.

A further embodiment provides for the outer and inner vertical webs or limbs of the slider to comprise boreholes in which a pin, which engages a recess in the sidewall of the drawer, is held. This pin prevents movements of the drawer in vertical and horizontal direction relative to the draw-out rail, so that the extended part which is bent away in a U-shape cannot be provided here either.

From an extended part of the front limb of the slider, a sprung arm, which extends approximately parallel to the limb, can be bent away, with said arm comprising a hook or an extended part which engages a recess in the draw-out rail. This embodiment creates an additional fixing point of the slider at the draw-out rail. The extended part can comprise an extended part or hook which point away at an angle, which extended part or hook engages a borehole in a side part.

A further embodiment provides for the slider to comprise a guide for a locking latch which can be pushed in against spring force, with said locking latch engaging a recess in the front wall or front panel of the drawer. For activation, the locking latch can comprise an actuation member.

Expediently, each supporting piece comprises a section which can be slid into the profile of each draw-out rail, with said section being attached in, or on, said draw-out rail. The section can be adapted to the profile of the draw-out rail such that it is centred in relation to said draw-out rail.

Expediently, each section or each draw-out rail comprises sprung projections or hooks, as well as recesses which interlock when the section is slid into the profile of the draw-out rail.

On its outside, each supporting piece can carry an upwards-jutting gudgeon or hook which engages a borehole in the lower front of a drawer side part. Furthermore, the gudgeon or hook can be arranged on a sprung arm which is connected to the supporting piece, with said sprung arm extending parallel to the draw-out rail. Preferably, on its side facing the draw-out rail, the sprung arm comprises a projection, which snaps into a locking recess on the underside of the draw-out rail.

In order to attach the supporting piece to the drawer, the front of said supporting piece can comprise a hook-shaped projection which engages a groove-shaped recess in the front wall of the drawer. The recess consists of a groove which extends at a right angle to the bottom of the drawer, so as to make it possible to lift the drawer from its draw-out rail for adjustment of said drawer.

A further embodiment of the invention provides for the adjustment device to comprise a wedge-shaped tab, held by a gudgeon in a borehole of a supporting piece, with said tab radially projecting beyond said gudgeon; with said tab being swivellable, relative to the supporting piece, by an actuation arm; and with said tab being able to be swivelled into the gap between the draw-out rail and the bottom of the drawer. Such wedge-shaped tabs which can be swivelled in between the draw-out rail and the bottom of the drawer, for raising the drawer relative to the draw-out rails, are for example known from DE 94 04 898 U1 and EP 0 701 787 B1. These known swivellable and wedge-shaped tabs are however not held by way of supporting rails on the draw-out rails, but instead, by way of holding pieces at the front plate of the drawer.

An improvement of the invention provides for the gudgeon which carries the tab to be rimmed by at least one screw-shaped surface, which is supported on a complementary counter-surface of the supporting piece, which counter-surface surrounds the borehole. In this way, the base which raises and supports the drawer is enlarged so that the drawer is effectively held in its set raised position, even if it is loaded with heavy objects.

Expediently, two screw-shaped surfaces which oppose each other are provided.

In each case one of the upper or lower screw-shaped surfaces can comprise locking recesses while the other screw-shaped surface can comprise locking projections so that raised positions set by turning the gudgeon are fixed.

Expediently, the incline of the screw surface and the incline of the wedge of the tab are identical. If, due to production tolerances, said incline is not exactly identical, the tabs and the screw surfaces nevertheless bear the load evenly, in particular if the supporting piece and/or the tab with the gudgeon has been made from injection-moulded plastic parts which provide a degree of elasticity and plasticity, so that manufacturing tolerances are evened out.

BRIEF DESCRIPTION OF THE DRAWINGS

Below, embodiments of the invention are explained in more detail by means of the drawing which shows the following.

DETAILED DESCRIPTION OF THE PREFERRED EMBODIMENTS

Figures 1, 2:
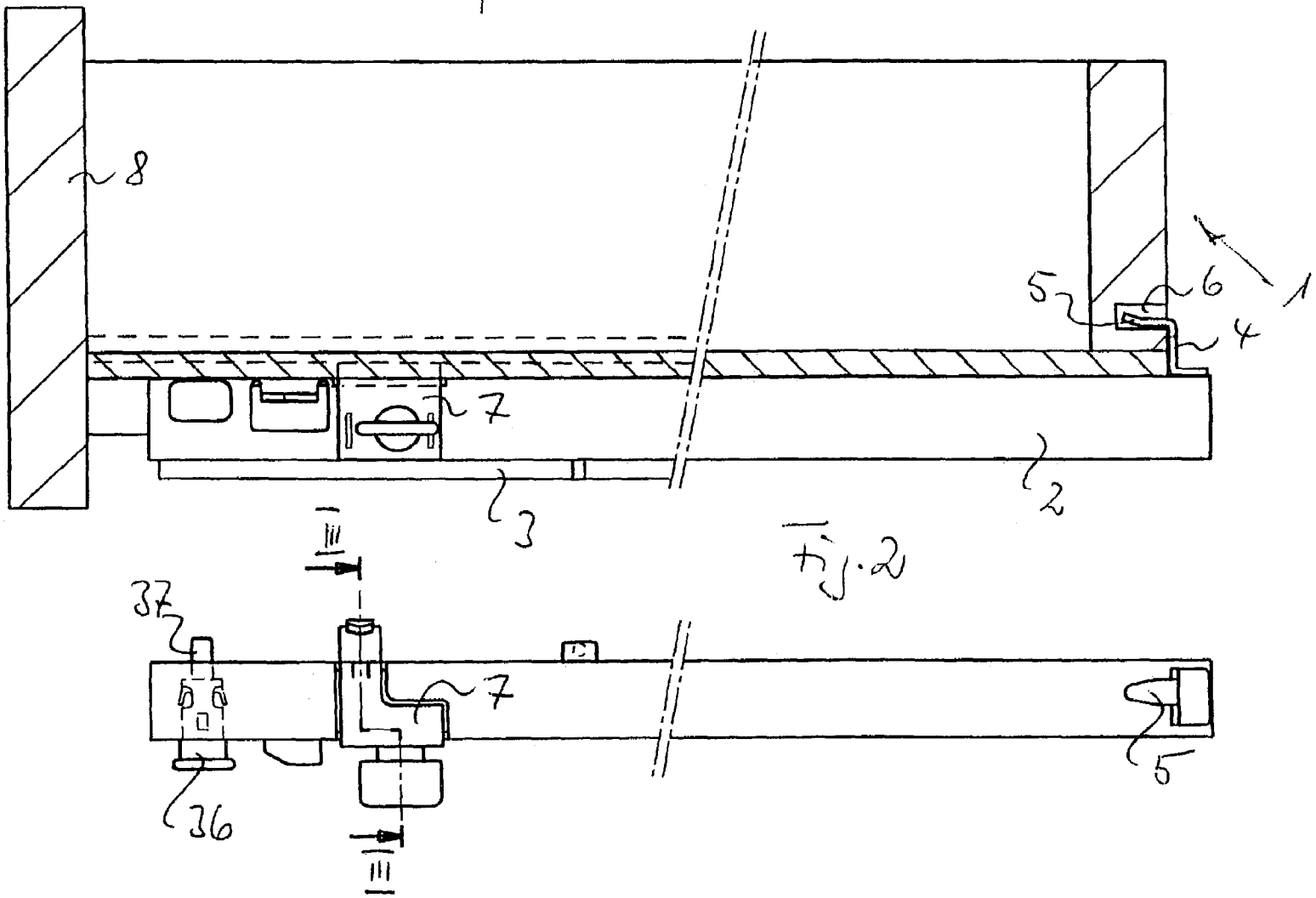
FIG. 1 a lateral view of a draw-out rail connected to a drawer.
FIG. 2 a top view of the draw-out rail according to FIG. 1.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

FIGS. 1 to 8 show a drawer 1 which is connected to a draw-out rail 2 which is guided so as to be longitudinally slidable, on a supporting rail 3 connected to a furniture carcass. At its rear end, the draw-out rail 2 comprises a hook 4 which is angled in a Z-shape; by means of an angled latch 5, said hook 4 engages a borehole 6 in the rear wall of the drawer 1 for connecting the draw-out rail 2 with the drawer. In its front end region, the draw-out rail 2 comprises a slider 7, which is movable at a right angle to said draw-out rail 2, with said slider 7, for the purpose of adjusting the height of the front panel 8 of the drawer 1, being upward-movable from the plane of the upper web part of the draw-out rail 2.

Figure 3:
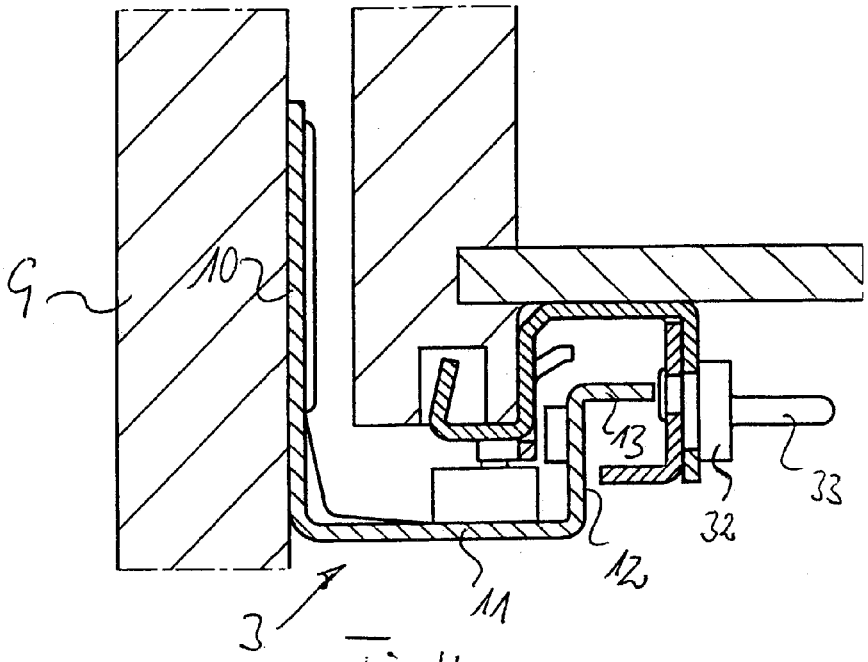
FIG. 3 a section of the draw-out rail guided on a supporting rail, along line III—III of FIG. 2, in a position in which the slider which raises the drawer is flush with the web part of the draw-out rail.
Figure 4:
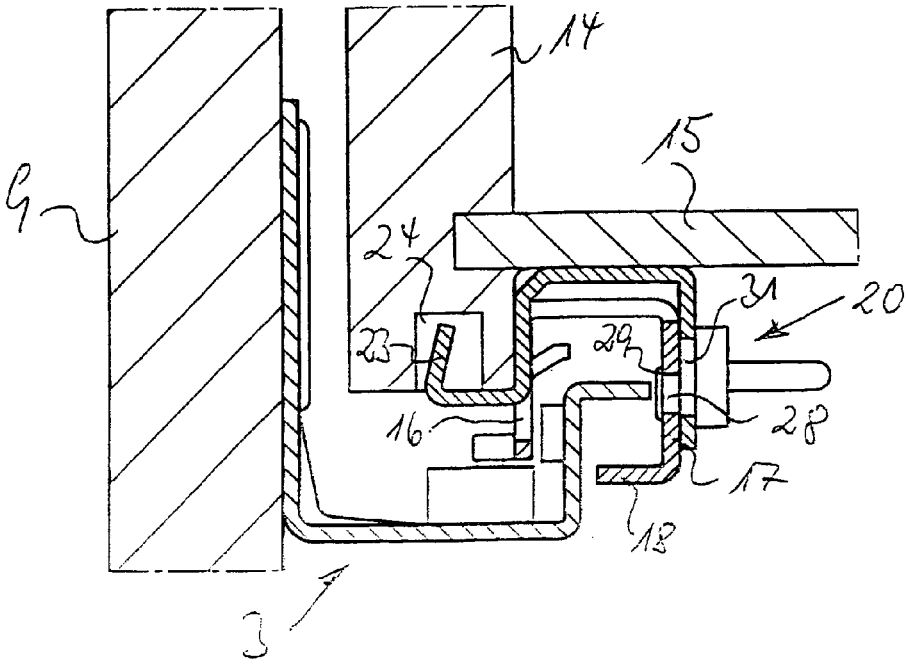
FIG. 4 a view corresponding to that of FIG. 3, in which the slider has raised the bottom of the drawer above the web part of the draw-out rail.

As shown in FIGS. 3 and 4, the upwards jutting limb 10 of a piece of furniture is connected to a sidewall 9 of a furniture part. The sections 11, 12, 13 are bent away at right angles from the vertical limb 10 of the supporting rail 3, wherein the horizontal end section 13 forms a running surface. The draw-out rail 2 has a U-shaped profile. From the inner limb 17 a web-shaped strip 18 is angled away towards the outside. The draw-out rail 2 is connected by way of its outer limb 16 to the drawer side part 14 below the bottom 15 of the drawer. Between the running surface 13 of the supporting rail 3 and a running surface of the draw-out rail 2, rolling bodies or sliding bodies are arranged in the normal way (not shown).

Figure 5:
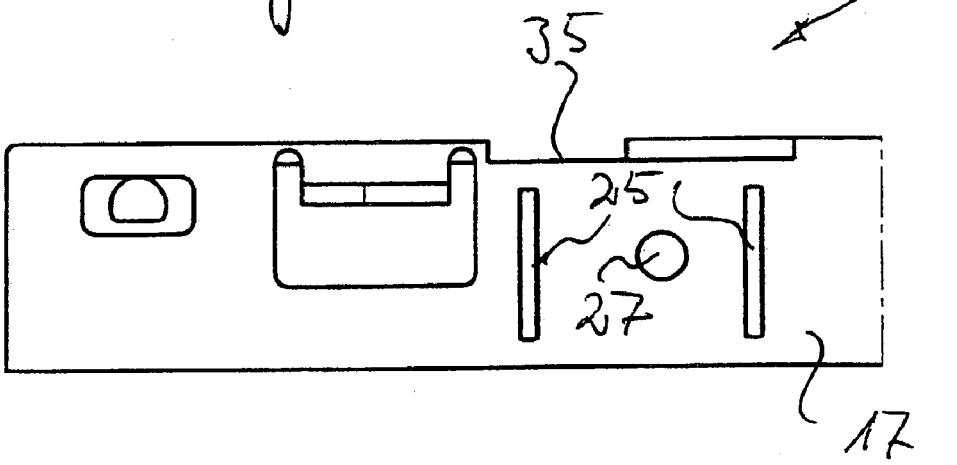
FIG. 5 a lateral view of the front part of the draw-out rail.
Figure 6:
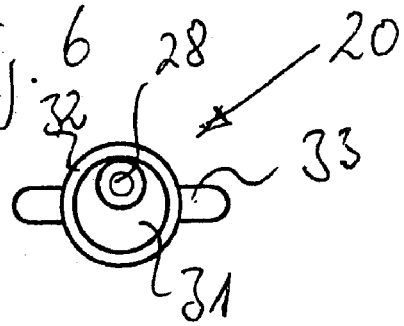
FIG. 6 a top view of the eccentric which is movable in height relative to the draw-out rail.
Figure 7:
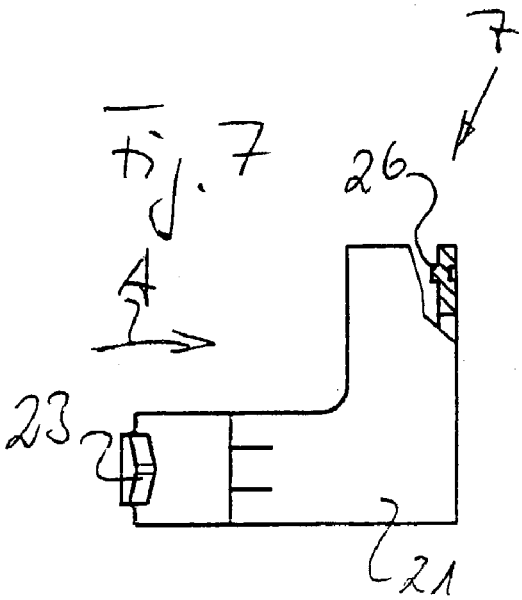
FIG. 7 a top view of the slider.
Figure 8:
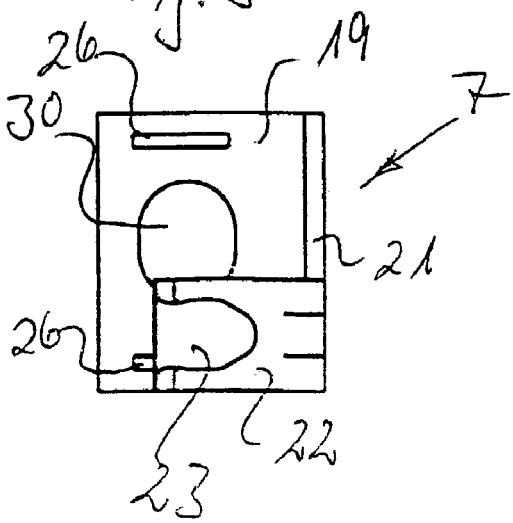
FIG. 8 a lateral view of the slider in the direction of arrow A in FIG. 7.
Figure 9:
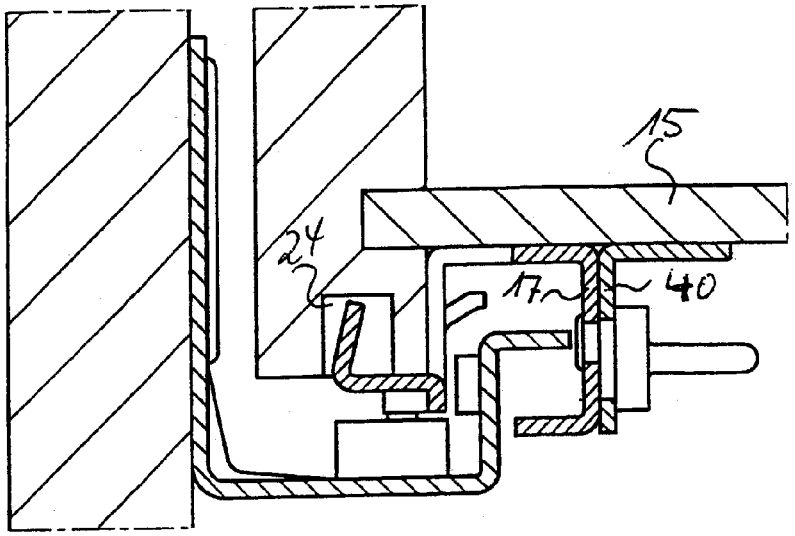
FIGS. 9 and 10 sections, which correspond to those in FIGS. 3 and 4, of the draw-out rails and supporting rails in which the supporting sections of the slider are angled away to the inside.
Figure 10:
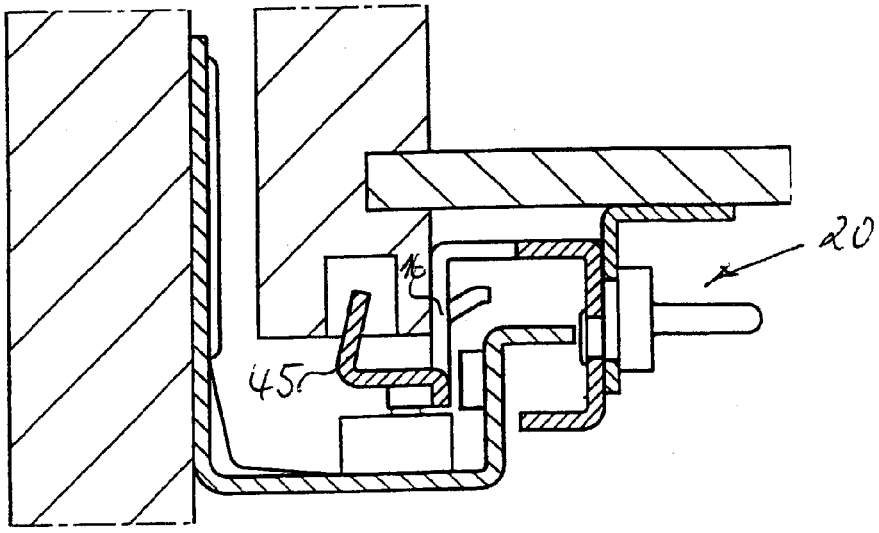
Figure 11:
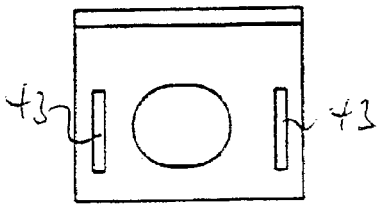
FIGS. 11 and 12 lateral views of the slider according to FIGS. 9 and 10.
Figure 12:
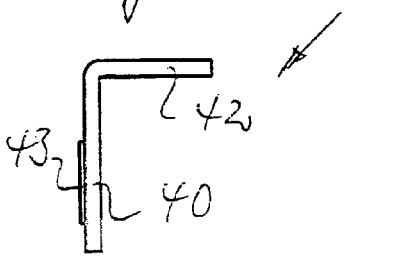
Figures 13, 14:
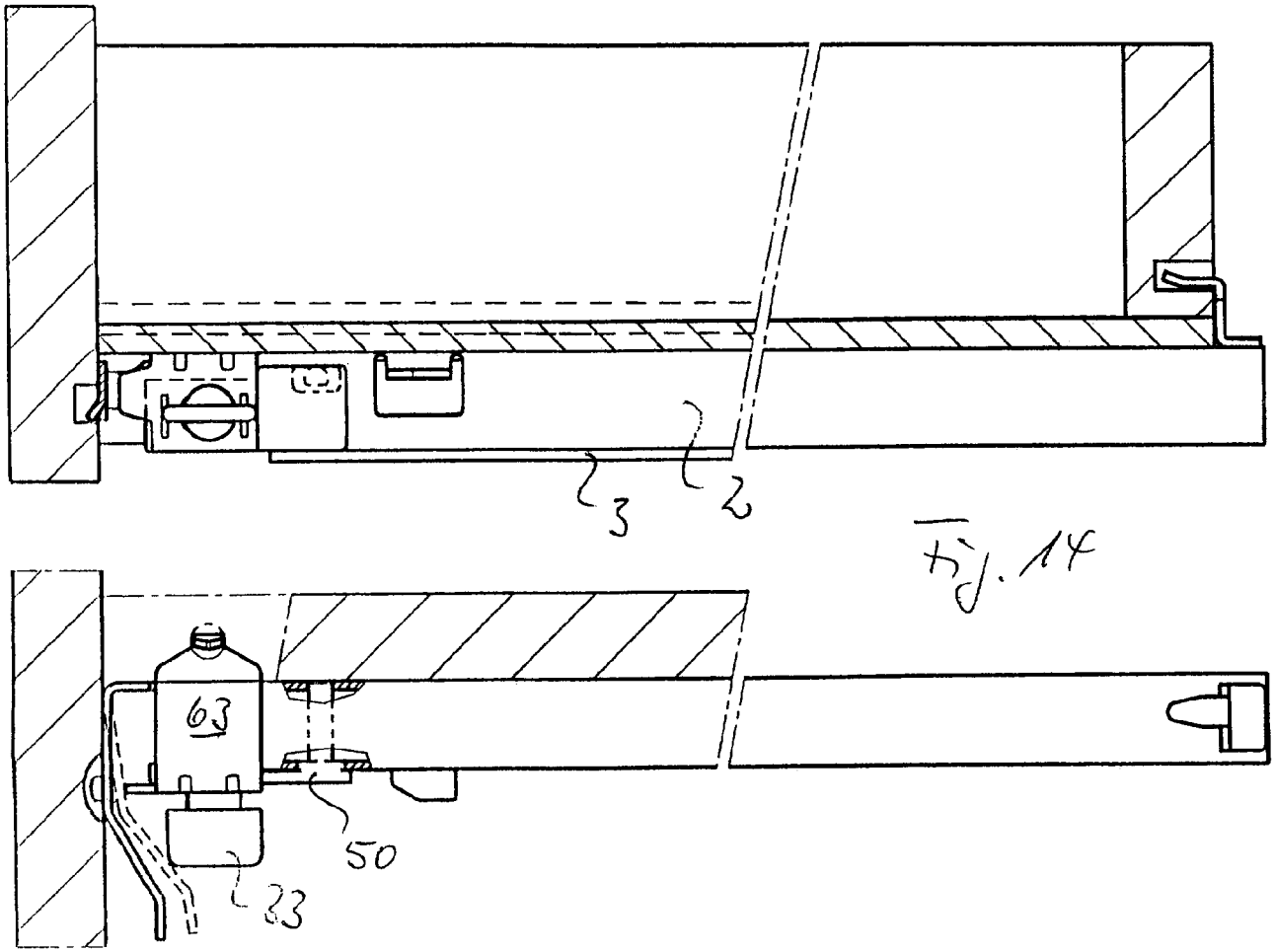
FIG. 13 a lateral view of a third embodiment of a draw-out rail connected to a drawer.
FIG. 14 a top view of a partial section of the draw-out rail according to FIG. 13.

The inner plate-shaped limb 19 of the essentially U-shaped slider 7, which has been bent from a stamped sheet metal part, is connected to the inner limb 17 of the U-shaped draw-out rail 2 by means of an eccentric 20. Bent away from the plate-shaped part 19 of the slider 7 is its web part 21 which is angle-shaped in top view. In turn, from the web part 21, a limb 22, which is parallel to the plate-shaped part 19, is angled away at a right angle. By way of two further angles, said limb 22 carries an upwards jutting hook 23 which engages a borehole in the lower front of the side part 14 of the drawer 1. By way of this hook-shaped part 23, the drawer 1 is secured against horizontal sliding, relative to the, draw-out rail 2. The front limb 17 of the draw-out rail 2 comprises two guide slots 25 arranged parallel to each other and aligned transversely, as shown in FIG. 5, with the plate-shaped limb 19 of the slider 7 being guided, so as to be transversely moveable, by said guide slots 25 by means of knobs or bulge-shaped webs 26 which engage said guide slots 25. Between the guide slots 25, the front limb 17 of the draw-out rail 2 comprises a borehole 27 in which the shank 28 of the eccentric 20 is held by a rivet head 29 so as to be axially rigid but rotatable. Between the web-like bulges 26 which engage the guide slots 25, the plate-shaped part 19 of the slider 7 comprises an elongated hole 30 which is engaged by the eccentric disc 31 of the eccentric 20. Adjacent to the eccentric disc 21, the eccentric 20 comprises a head disk 32 which laps the rim of the elongated hole 30. For manual actuation, the head disc 32 comprises a wing-shaped part 33. Instead of comprising a wing-shaped part, the head disc could also comprise a slot or a cross recess for actuation with a screwdriver.

The web part 21 of the slider 7 and the limb 22, which is angled away from said slider 7, are located in corresponding recesses or free punches 35 of the web part and the outer limb of the draw-out rail 2.

For anchoring the draw-out rail 2 to the front part of the drawer, a pin 36 held in the limbs of the draw-out rail and in boreholes can be provided, which pin 36 can be pushed in by said limbs of the draw-out rail. The front end 37 of said pin 36 engages an elongated hole in the sidewall of the drawer, which makes it possible to move the drawer in height relative to the front end region of the draw-out rail 2, while preventing complete lifting off.

The supporting rails and draw-out rails with sliders are arranged on both sides of the drawer.

The embodiment according to FIGS. 9 to 12 differs from that according to FIGS. 1 to 8 in that the slider 41 comprises an angular piece whose vertical limb 40, by means of bulges 43, which are arranged parallel in relation to each other, is guided in guide slots of the limb 17 so as to be transversely movable, while the horizontal limb 42 of said slider 7 is angled so as to point away from the draw-out rail. By means of the eccentric 20, the bottom 15 of the drawer can be raised from the plane of the web part of the draw-out rail 2 in the way shown in FIG. 10.

From part of the web part and the outer limb of the draw-out rail 2, a latch 45 is bent out in a hook shape, with the upwards jutting end section of said latch 45 engaging the borehole 24 of the front of the side part of the drawer.

In the embodiments according to FIGS. 13 to 25, the slider which is slidable transversely to the draw-out rail 2 is arranged so as to be transversely slidable at a supporting part 50 which can be connected to the outer end of the draw-out rail 2. The supporting part 50 comprises a plate-shaped part which supports a pin 51 at right angles. The plate-shaped part comprises a first section 52 which after connecting the supporting part to the draw-out rail 2 covers the end region of the inner limb, and further comprises an adjoining section 53 which is thicker, which adjoining section 53 connects to the first section 52 by means of a step 54, and, by way of said step 54, is supported by the front edge of the inner limb of the draw-out rail. The pin 51 connects to the plate-shaped section 52 by way of an upper base-shaped raised part 55 of essentially rectangular cross section. The pin 51 itself can be round and at least in its end region comprises a flat part 56. The base-shaped raised part 55 is non-rotatably held in a complementary recess 57 of the inner limb 17 of the draw-out rail 2. The end section of the pin 51, which end section comprises a flat part, engages a complementary borehole 58 of the outer limb of the draw-out rail 2 and for holding can comprise a rivet head.

Figure 16:
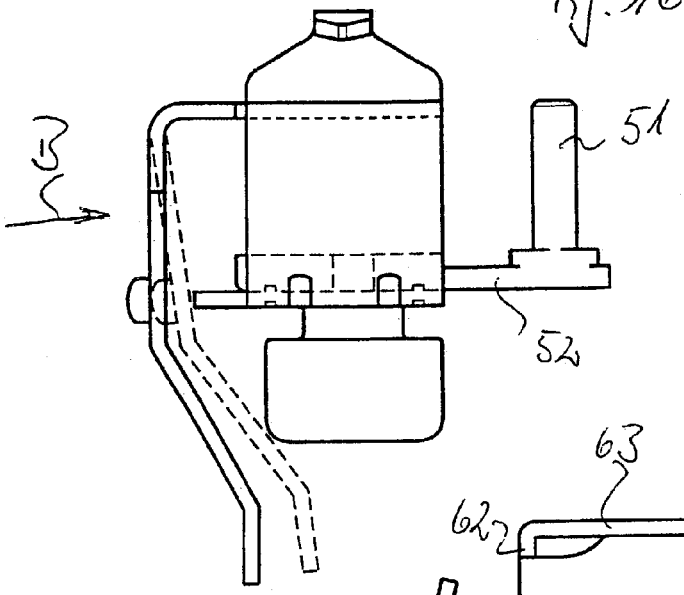
FIG. 16 a top view of the slider according to FIGS. 13 and 14, with the supporting part connecting said slider with the draw-out rail.
Figure 17:
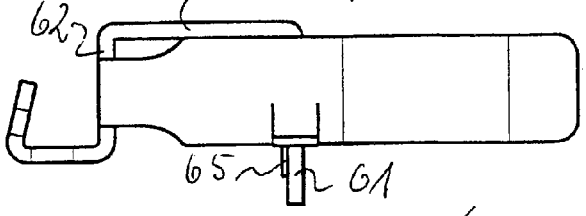
FIG. 17 a lateral view of the slider in the direction of arrow B of FIG. 16.
Figure 18:
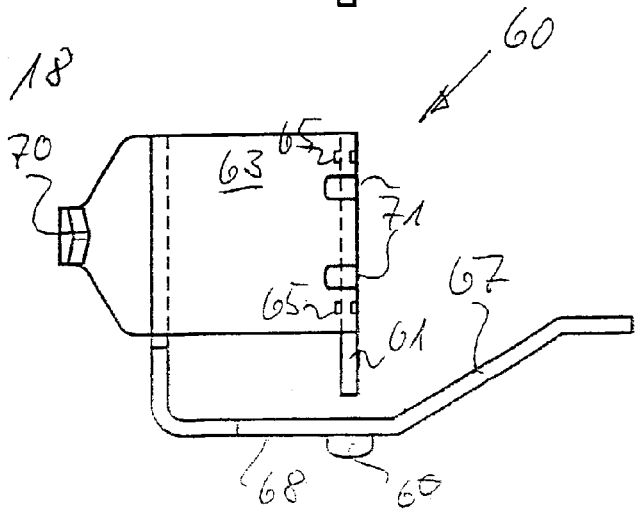
FIG. 18 a top view of the slider according to FIGS. 16 and 17.
Figure 19:
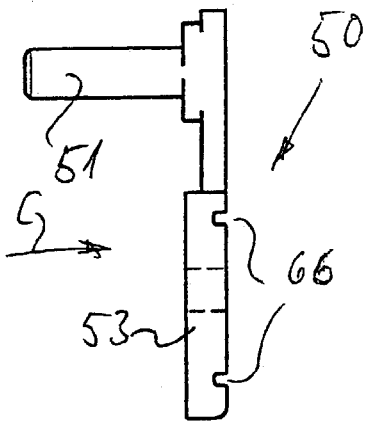
FIG. 19 a lateral view of the supporting part.
Figure 20:
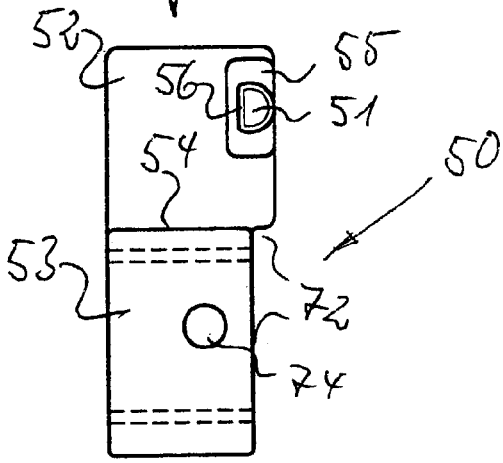
FIG. 20 a top view, in the direction of arrow C in FIG. 19, of the supporting part according to FIG. 19.

The slider 60 again comprises a base body bent in U-shape, with an inner vertical limb 61, an outer vertical limb 62 and a web part 63 connecting said outer vertical limb 62, with the bottom of the drawer being supported by said web part 63 in the case of a height-adjustment of the slider. The inner limb 61 of the slider 60 comprises guide pieces 65 which are raised in the manner of bulges and which are arranged parallel in relation to each other, with said guide pieces 65 engaging guide grooves 66, which are arranged parallel to each other, of the thicker section 53 of the supporting part 50. From the outer limb 62 of the slider 60, a lateral extended part is angled away by way of three angles to a sprung lever 67, as is shown in FIGS. 16 to 18, with said sprung lever 67 at its section 68 which is aligned perpendicular to the limbs 61, 62 comprising a projection or a latch 69 which points away at an angle, which latch 69, for holding, engages a recess at the interior of the front panel of the drawer.

From the outer limb 62 of the slider 60, an upwards jutting hook-shaped part 70 is angled away by a double angle, with said hook-shaped part 7 engaging a borehole in the lower front of a sidewall of the drawer.

In the transition area from the inner limb 61 to the web part 63, the slider 60 comprises depressed swages 71 which are supported in an upper step 72 between the sections 52, 53 of the plate-shaped part of the supporting part 50 and which swages 71 form end stops which hold the web part 63 of the slider in the moved-in position in a position which is flush with the web part of the draw-out rail 2.

The front limb 61 of the slider 60 is held, in the way described in the first two embodiments, by an eccentric, to the section 53 of the supporting part 50, wherein the shank part of the eccentric is rotatably held in the borehole 74 of the section 53.

Figure 21:
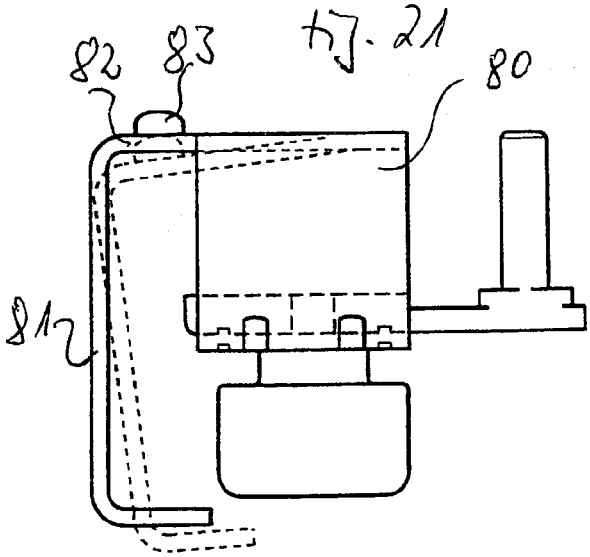
FIGS. 21 and 22 modified embodiments of the slider connected to the supporting part.

FIG. 21 shows the embodiment of a slider 80 which clearly differs from slider 60 in that from the outer limb 62, by means of two angles a sprung arm 81 is laterally angled away, with a projection or an angled-off latch 83 being arranged at the section 82 of the sprung arm 81 which laterally extends the limb 82, with said latch 83 that points away at an angle, engaging a corresponding recess in the sidewall of the drawer.

Figure 15:
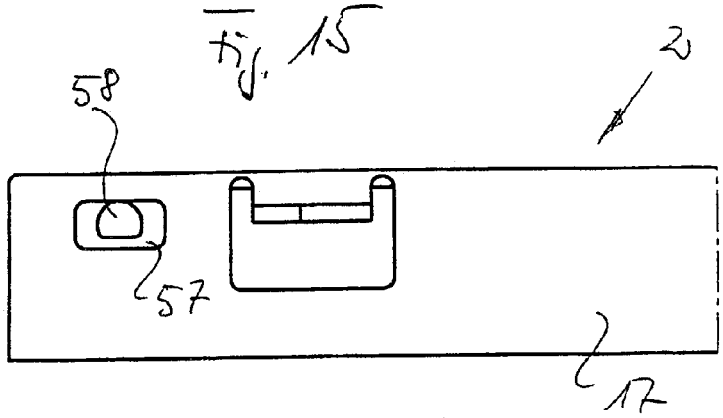
FIG. 15 a lateral view of the front part of the draw-out rail according to FIGS. 13 and 14.
Figure 22:
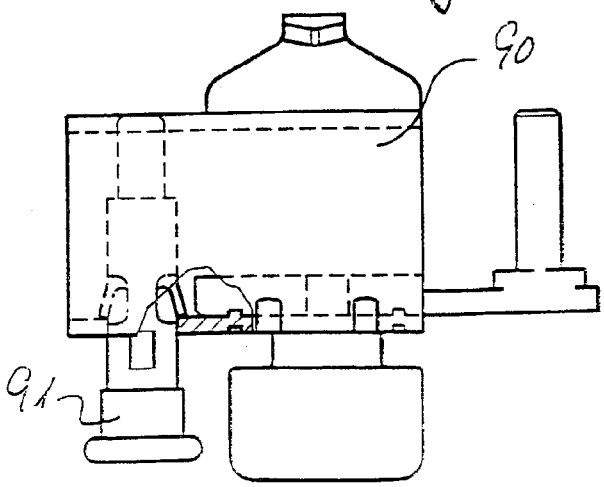

In the embodiment of the slider 90 according to FIG. 22, the limbs 61 and 62 of the slider comprise boreholes of the type shown in FIG. 15 in which a holding pin 91 is held whose front section engages a corresponding borehole in the side part of the drawer.

Figure 23:
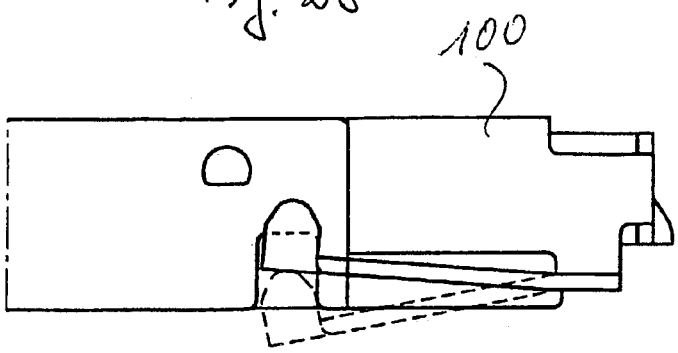
FIG. 23 a lateral view of a further embodiment of a slider.
Figure 24:
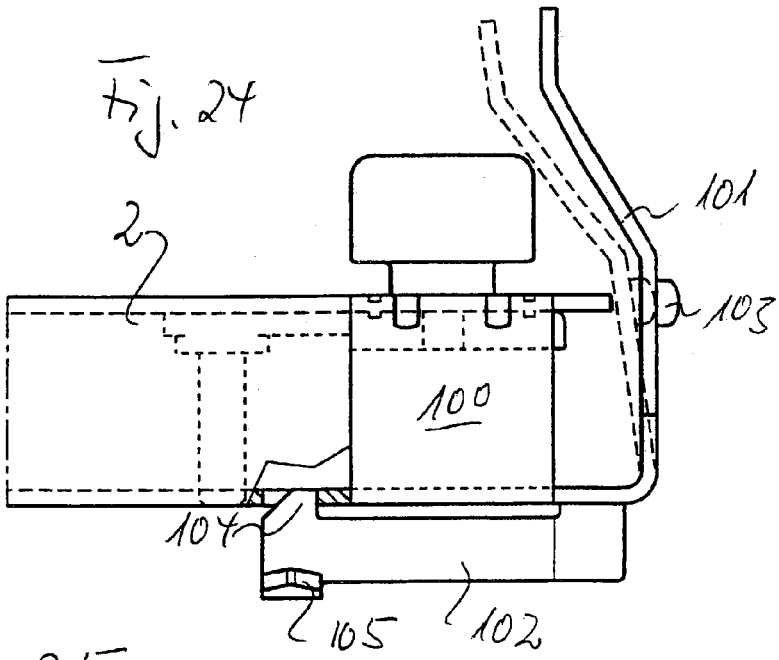
FIG. 24 a top view of the slider in FIG. 23.

In the embodiment according to FIGS. 23 and 24, from one side of the outer limb sprung levers 101 and 102 are angled away in the way shown in FIGS. 23 and 24, of which levers lever 101 comprises a projection or a latch 103 which points away at an angle, which latch 103 engages a corresponding recess on the inside of the front panel of the drawer. From the section of the sprung arm 101, which section laterally extends the outer limb of the slider 100, the arm 102 is angled away in a plane which is parallel to the web part of the slider 100. The arm 102 extends parallel to the draw-out rail 2 and at its end comprises two hooks 104 and 105, of which the hook 104 engages a recess in the underside of the outer limb of the draw-out rail 2, while the hook 105 engages a recess in the lower front of the drawer.

Figure 25:
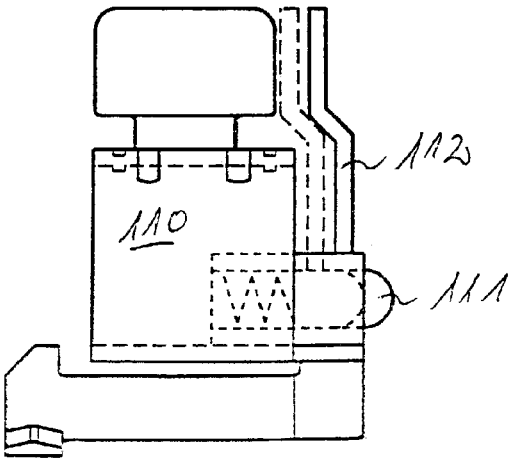
FIG. 25 a top view of a further embodiment of a slider.

The slider 110 shown in FIG. 25 differs from the slider according to FIGS. 23 and 24 in that, instead of the sprung arm 101, a locking member 111 is provided which can be pushed in against spring force, which locking member 111 engages a borehole on the inside of the front panel and for actuation comprises an actuation lever 112.

Figure 26:
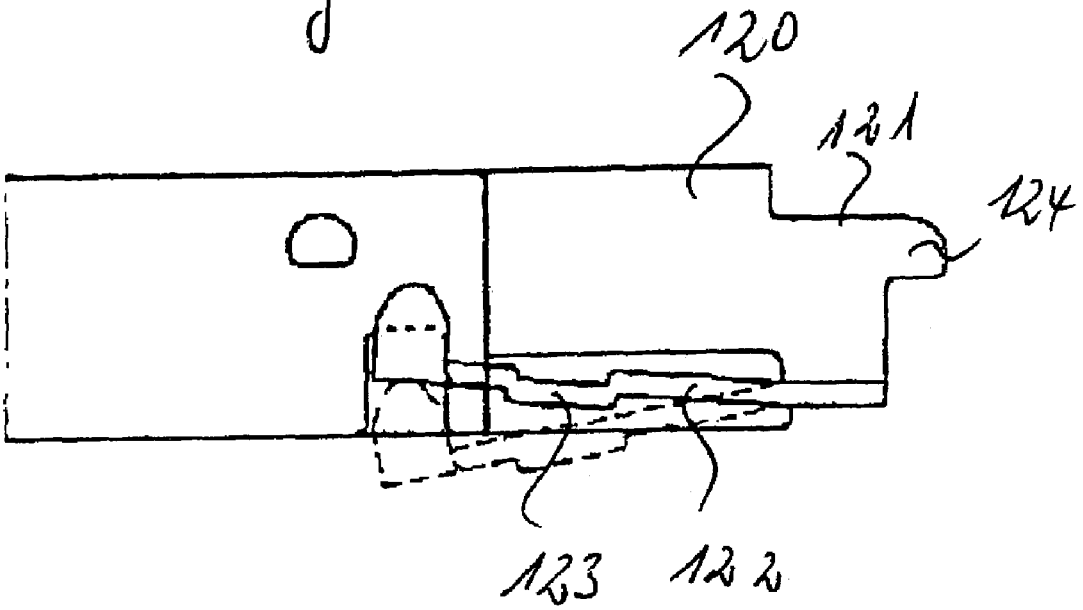
FIG. 26 a lateral view of a modified embodiment of a slider.
Figure 27:
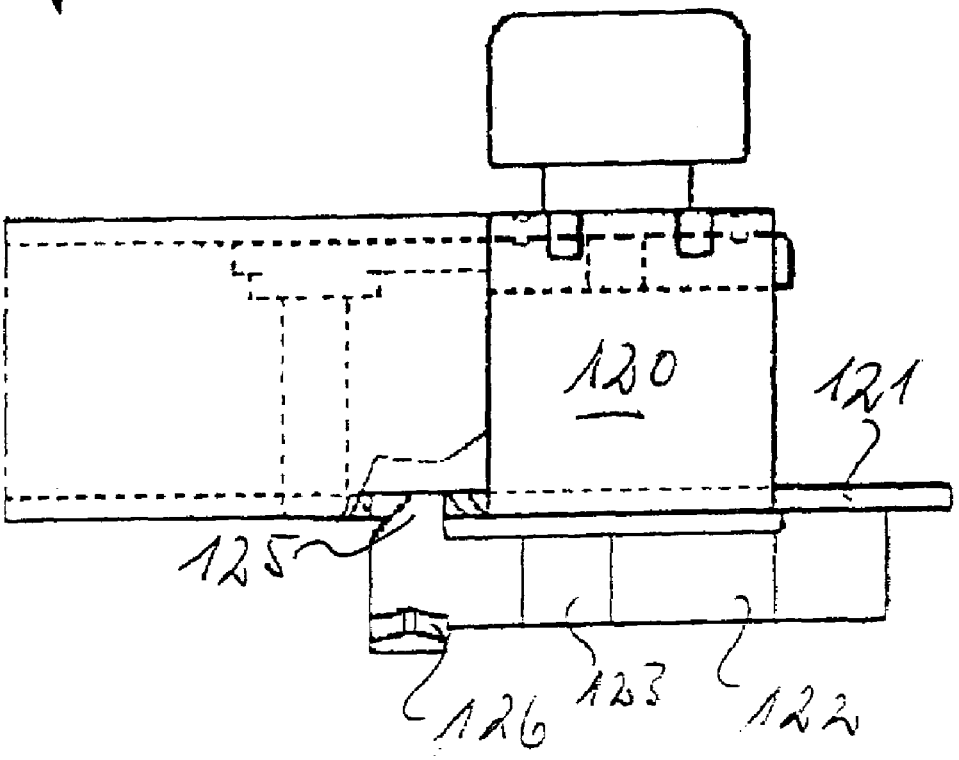
FIG. 27 a top view of the slider according to FIG. 26.
Figure 28:
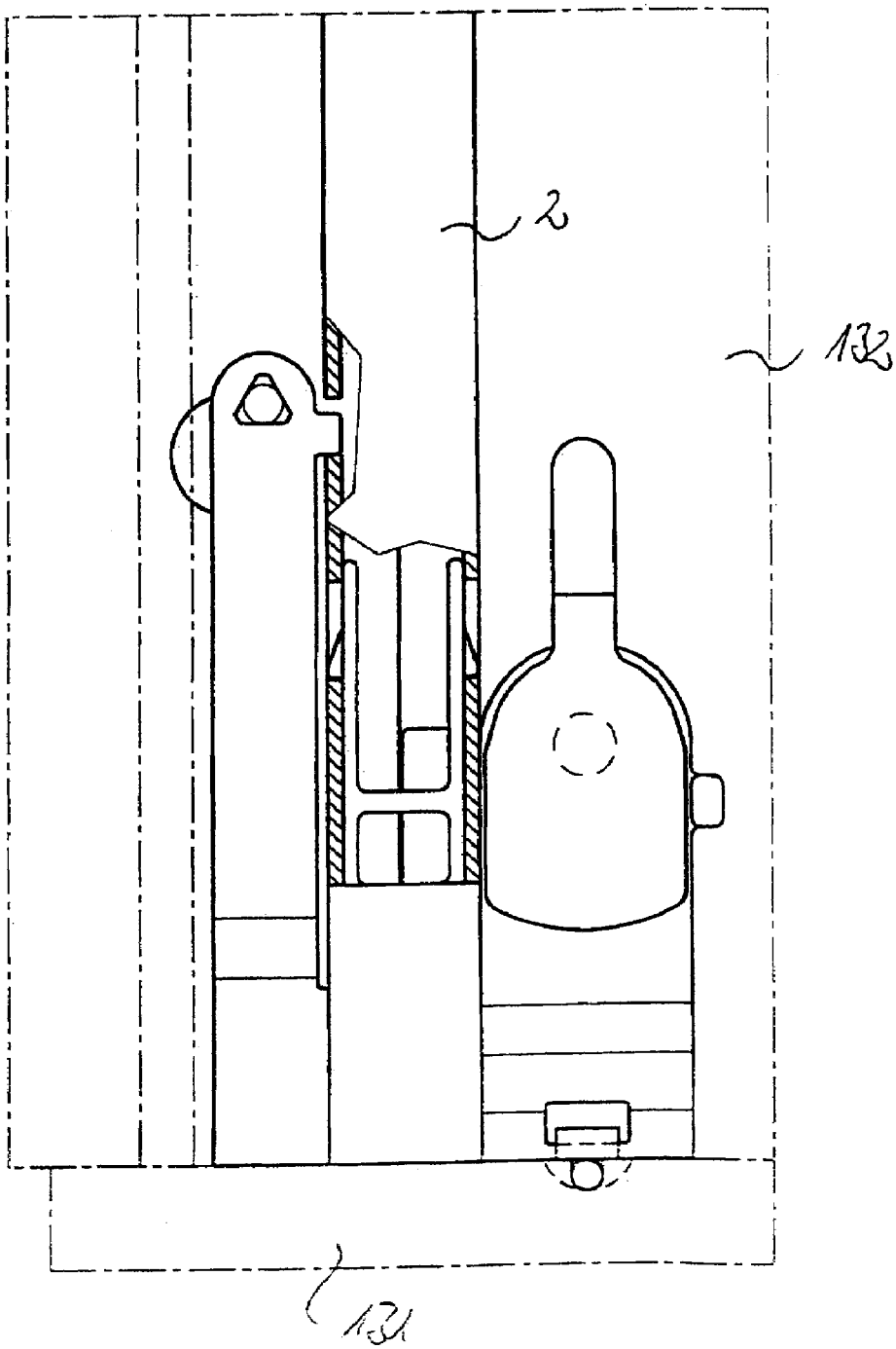
FIG. 28 a top view of a draw-out rail of a drawer which at its end facing the front panel of the drawer is connected to a supporting piece on which an adjustment device is arranged.
Figure 29:
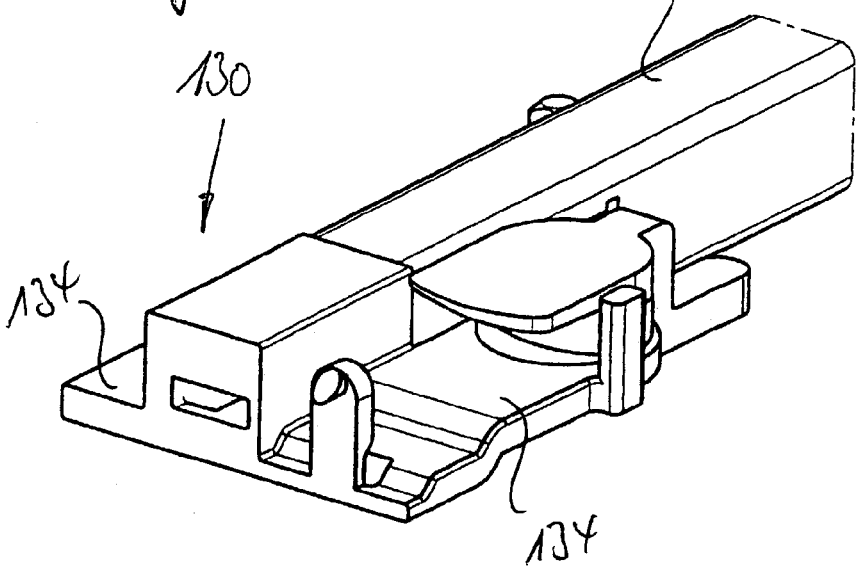
FIGS. 29 and 30 perspective views of the supporting piece interlocked with the draw-out rail.

FIGS. 26 and 27 shows the embodiment of a slider 120 in which a section 121 is provided which laterally extends the outer limb, with said section 121 comprising a projection 124 which extends said section 121, with said projection 124 being able to engage a corresponding recess in the drawer front wall or the drawer panel.

Furthermore, a sprung arm 122 is angled away from the section of the slider 120 which section laterally extends the outer limb of the slider 120. The sprung arm 122 extends parallel to the draw-out rail 2 and at its end comprises two hooks 125, 126 in the way described in FIGS. 23 and 24. In addition, the sprung arm 122 comprises an outward bulge 123 formed by crimping. In the installed state, a tool for disconnecting the connection can be inserted into said outward bulge 123. For engagement of the projection 124 in a corresponding recess of the front panel of the drawer, said drawer is inserted from above and slid to the rear.

Figure 30:
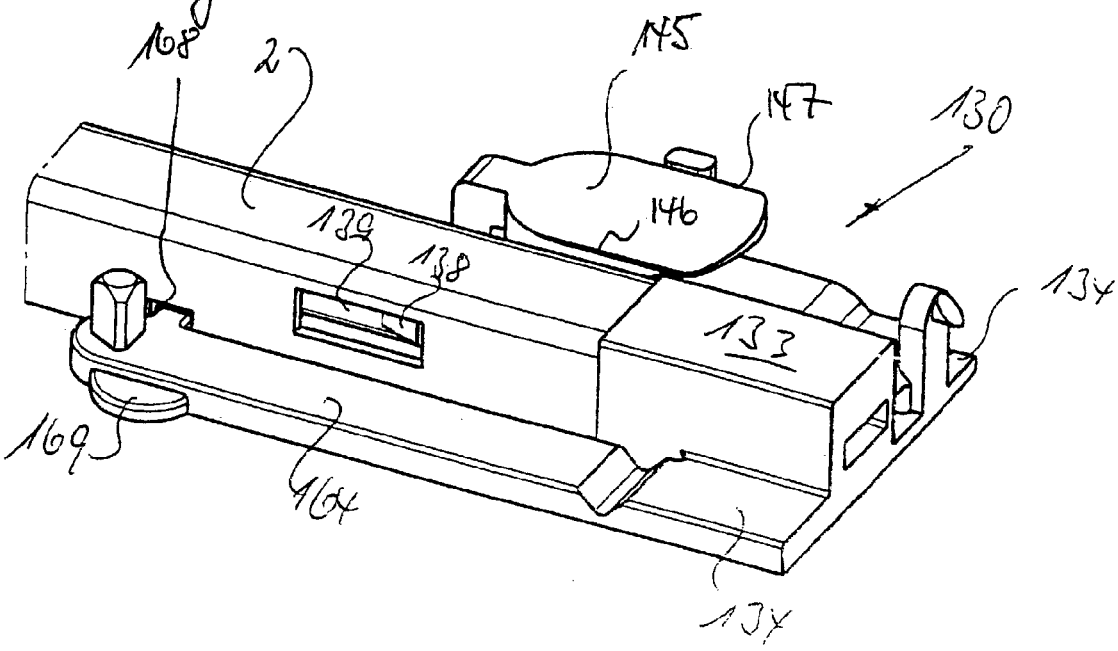
Figure 31:
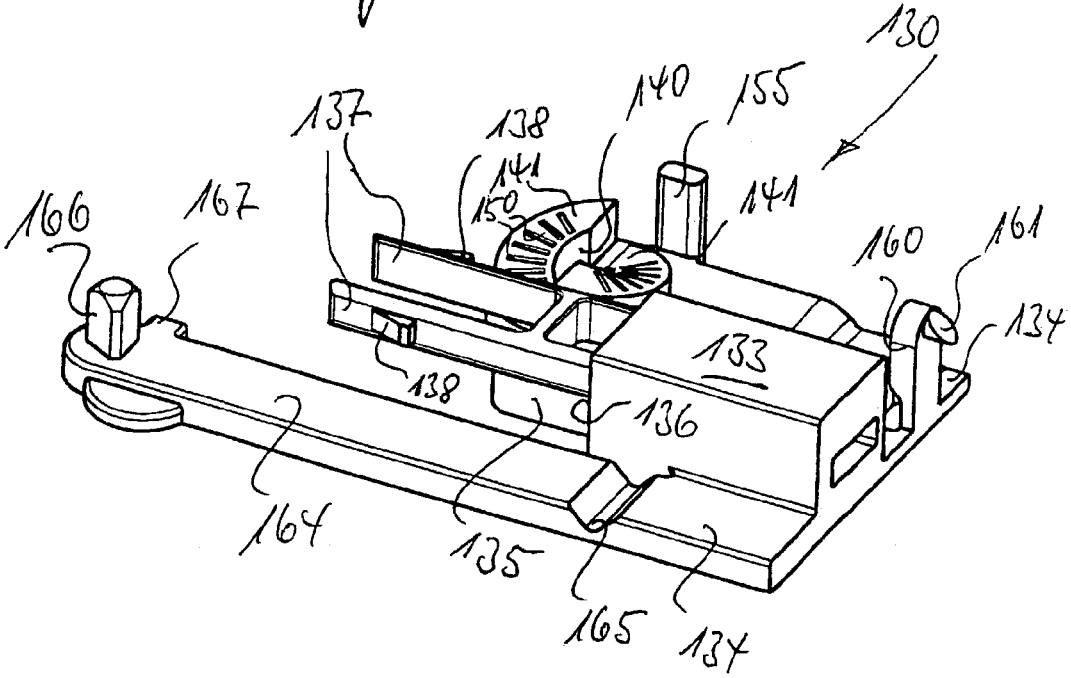
FIG. 31 a perspective view of the supporting piece with a wedge-shaped tab raised from said supporting piece.
Figure 32:
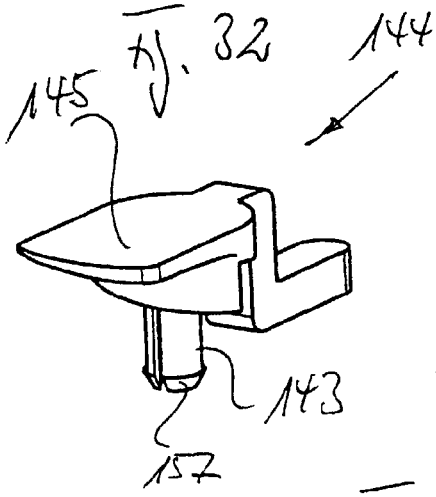
FIGS. 32 and 33 perspective views of the wedge-shaped tab which comprises a bearing gudgeon.
Figure 33:
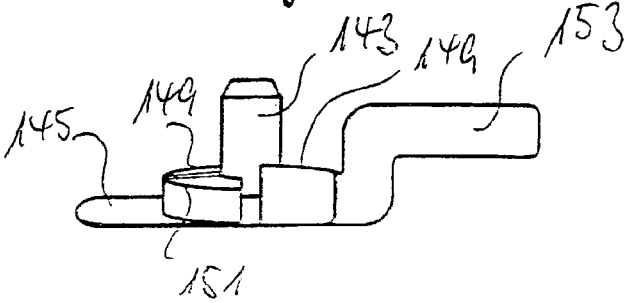

In the embodiment according to FIGS. 28 to 33, the adjustment device for adjusting the height of the front panel 131 of the drawer 132 is born by a supporting piece 130 which is interlocked with the draw-out rail 2. The supporting piece 130 comprises an approximately rectangular block 133 whose underside includes lateral webs 134. At its side facing the front end of the draw-out rail 2, the block 133 comprises a rectangular centring part 135 whose profile matches the profile of the draw-out rail 2 such that, fitting into the draw-out rail, it can be slid in up to a step 136 which is formed between the centring part 135 and the block 133. The section of the supporting piece 130, which section can be slid into the profile of the draw-out rail 2, further includes sprung arms 137 which have hook-shaped projections 138 with stop faces, which when the slidable section of the supporting piece 130 is slid in, snap into window-like recesses 139 in the lateral walls of the profile of the draw-out rails 2, if the step 136 abuts against the front edge of the draw-out rail 2. The webs 134 of the supporting pieces 130, which webs 134 are situated on the inside, are extended beyond the step 136 so that the extended parts are aligned parallel to the insides of the supporting rails 2. Beside the supporting rails 2, the webs 134 which point towards the inside of the drawer includes a borehole 140 which is concentric in relation to the webs 134, with opposing screw surfaces 141. These screw surfaces extend approximately along half of a flat gudgeon connected to the webs 134. Inserted into the borehole 140 is the gudgeon 143 of a swivelling part 144, with the gudgeon 143 being rotatably retained in the borehole 140. At its upper end, the gudgeon 143 includes a tab 145 whose interior edge in its installation position or home position as shown in FIG. 30 extends parallel to the upper inner edge of the draw-out rail 2. Starting from its front edge 146, the approximately rectangular tab 145 includes a wedge-shaped profile which rises to its rear edge 147. Below the tab 145, the pin 143 includes two screw surfaces 149 formed on two broadened sections and arranged concentrically to said tab 145, with the screw surfaces 149 being complementary to the screw surfaces 141. The screw surfaces 141 have radial locking recesses 150 which interact with locking projections 151 on the screw surfaces 149, so that after rotating the pin 143, set raised positions are fixed by way of interlocking. On the part of the pin 143, which part faces the tab 145, the pin 143 includes a crimped actuation arm 153. In its installation position, the tab 145 is secured by an upwards jutting end stop 155 formed on the inner webs 134.

For retention in the borehole 140, the pin comprises a middle slot. At its lower end, the two parts of the pin 143 comprise a collar 157 which comprises stop faces. After the pin is pushed into the borehole, said collar 157 encompasses the lower edge of the borehole 140 with an annular step.

On the front end, the inner web 134 comprises an upwards jutting projection 160 which at its upper end comprises a hook 161 which engages a vertical longitudinal groove on the rear of the front panel of the drawer.

The outer webs 134 of the supporting pieces 130 include arms 164 which extend the supporting pieces 130, with the arms 164 extending parallel to the draw-out rail 2. In order to improve the spring characteristics of the arms 164, in the transitional area to the webs 134, the arms 164 include notches 165 which reduce the cross sections of the webs 134. At their ends, the sprung arms 164 include upwards jutting gudgeons 166 which engage boreholes of the lower fronts of the drawer side parts. On their insides, the sprung arms 164 include projections 167 which point inward, which projections, for additionally locking the supporting pieces 130 onto the draw-out rails, engage two recesses 168 on the outer lower edges of the supporting rails. In order to be able to hinge the arms 164 downward, for the purpose of undoing them, they include actuation pieces 169.

Expediently, the supporting pieces 130 and the tab 145 swivellably held on them by way of the pin 143 comprise injection-moulded plastic parts.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A device for adjusting the height of a drawer as mounted in a furniture carcass comprising:

a drawer having a draw-out rail for guiding said drawer on supporting rails of said furniture carcass;

an adjustment device configured to raise and lower the drawer relative to the supporting rails, said adjustment device being borne by a supporting piece which is interlocked with a front end region of said draw-out rail, said front end region facing a front wall or panel of the drawer, said supporting piece including an element for holding the drawer and a section adapted to be inserted into a longitudinal channel of said draw-out rail and attached thereto, said section when inserted being substantially parallel with and centered within said longitudinal channel, said section and said draw-out rail including sprung projections and recesses, respectively, which interlock when the section is slid into the channel of the draw-out rail.

2. The device according to claim 1, wherein said element is an upwards-jutting gudgeon or hook on an outside thereof, said gudgeon or hook engaging a borehole in a drawer side part.

3. The device according to claim 2, wherein the gudgeon or hook is arranged on a sprung arm that is connected to the supporting piece, said sprung arm extending substantially parallel to the draw-out rail.

4. The device according to claim 3, wherein, on a side of said sprung arm facing the draw-out rail, said sprung arm includes a projection that snaps into a locking recess on the draw-out rail.

5. The device according to claim 1, wherein the element is a hook-shaped projection that engages a groove-shaped recess in the front wall of the drawer.

6. The device according to claim 1, wherein the adjustment device includes a wedge-shaped tab, held by a gudgeon in a borehole of the supporting piece, said tab radially projecting beyond said gudgeon and being swivellable, relative to the supporting piece, via an actuation arm, and said tab being able to be swivelled into a gap between the draw-out rail and a bottom of the drawer.

7. The device according to claim 6, wherein the gudgeon that carries the tab is rimmed by at least one screw-shaped surface which is supported on a complementary screw-shaped counter-surface of the supporting piece, which counter-surface surrounds the borehole.

8. The device according to claim 6, wherein upper and lower screw-shaped surfaces are provided which oppose each other.

9. The device according to claim 8, wherein one of said upper or lower screw-shaped surfaces includes locking recesses, while the other screw-shaped surface includes locking projections.

10. The device according to claim 8, wherein an incline of the screw surfaces and an incline of the wedge of the tab are identical.

11. The device according to claim 6, wherein the supporting piece and/or the tab with the gudgeon are made from injection-moulded plastic parts.

12. A device for raising and lowering a drawer which is guided by draw-out rails on supporting rails on a furniture carcass, said device comprising a supporting piece positioned adjacent a front panel of said drawer, and an adjustment device on the supporting piece said supporting piece having an arm extending away from said front panel and configured to slide into a longitudinal channel defined by a length of a respective draw-out rail, said arm having a latching mechanism that is configured to snap into locking engagement with a corresponding structure on said draw-out rail to secure the supporting piece to the draw-out rail when said arm is fully inserted therein, said supporting piece carrying an upwards-jutting gudgeon or hook on an outside thereof, said gudgeon or hook engaging a borehole in a drawer side part.

13. The device according to claim 12, wherein said supporting piece includes a centering part having a profile that corresponds with a profile of said channel such that said arm is inserted into in the draw-out rail.

14. The device according to claim 12, wherein said latching mechanism includes a sprung projection and said corresponding structure includes a recess, said sprung projection snapping into said recess when the arm is fully inserted in the draw-out rail.

15. The device according to claim 12, wherein the gudgeon or hook is arranged in a sprung arm that is connected to the supporting piece and extends substantially parallel to the draw-out rail.

16. The device according to claim 15, wherein, on a side of said sprung arm facing the draw-out rail, said sprung arm includes a projection that snaps into a locking recess on the draw-out rail.

17. The device according to claim 12, wherein the supporting piece includes a hook-shaped projection that engages a groove-shaped recess in the front panel of the drawer.

18. The device according to claim 12, wherein the adjustment device includes a wedge-shaped tab held by a gudgeon or hook in a borehole of the supporting piece and radially projecting beyond said gudgeon.

19. The device according to claim 18, wherein said tab is swivellable, relative to the supporting piece, via an actuation arm so as to be able to be swivelled into a gap between the draw-out rail and a bottom of the drawer.

20. The device according to claim 19, wherein the gudgeon that carries the tab is rimmed by at least one screw-shaped surface supported on a complementary screw-shaped counter-surface of the supporting piece surrounding the borehole.

21. The device according to claim 20, wherein upper and lower screw-shaped surfaces are provided which oppose each other.

22. The device according to claim 21, wherein one of said upper or lower screw-shaped surfaces includes locking recesses, while the other screw-shaped surface includes locking projections.

23. The device according to claim 21, wherein an incline of the screw surfaces and an incline of the wedge of the tab are identical.

24. The device according to claim 12, wherein said arm includes a pair of sprung arms spaced from one another to engage opposite inner surfaces of said longitudinal channel when inserted therein.

25. In combination, a device for raising and lowering a drawer, a furniture carcass with supporting rails, a drawer having a draw-out rail configured to be supported on said supporting rails of said furniture carcass, and an adjustment device said device including a supporting piece positioned adjacent a front panel of said drawer, said supporting piece having a first arm extending away from said front panel and configured to slide into a longitudinal channel defined by a length of said draw-out rail, and a second arm extending substantially parallel with said first arm, said second arm having a latching mechanism that interlocks with a corresponding structure on said draw-out rail when said first arm is fully inserted in said channel to secure said supporting piece to said draw-out rail and said second arm including an actuation mechanism for releasing said latching mechanism.

26. The combination according to claim 25, wherein said latching mechanism includes a projection facing said first arm and said corresponding structure includes a locking recess, said projection snapping into said locking recess on the draw-out rail when the first arm is fully inserted in said draw-out rail.

27. The combination according to claim 25, wherein said supporting piece includes a centering part having a profile that corresponds with a profile of said channel such that said first arm is inserted into the draw-out rail.

28. The combination according to claim 25, wherein said first arm also includes a latching mechanism that interlocks with said draw-out rail.

29. The combination according to claim 28, wherein said first arm latching mechanism includes a sprung projection or hook that interlocks in a corresponding recess in said draw-out rail when the first arm is fully inserted in the draw-out rail.

30. The combination according to claim 25, wherein said second arm carries an upwards-jutting gudgeon or hook on an outside thereof, said gudgeon or hook engaging a borehole in a drawer side part.

31. The combination according to claim 25, wherein the adjustment device includes a wedge-shaped tab held by a gudgeon in a borehole of the supporting piece and radially projecting beyond said gudgeon.

32. The combination according to claim 31, wherein said tab is swivellable, relative to the supporting piece, via an actuation arm so as to be able to be swivelled into a gap between the draw-out rail and a bottom of the drawer.

33. The combination according to claim 32, wherein the gudgeon that carries the tab is rimmed by at least one screw-shaped surface supported on a complementary screw-shaped counter-surface of the supporting piece surrounding the borehole.

34. The combination according to claim 33, wherein upper and lower screw-shaped surfaces are provided which oppose each other, one of said upper or lower screw-shaped surfaces including locking recesses, while the other screw-shaped surface includes locking projections.

35. A device for raising and lowering a drawer which is guided by draw-out rails on supporting rails on a furniture carcass, said device comprising a supporting piece positioned adjacent a front panel of said drawer and an adjustment device on the supporting piece, said supporting piece having a pair of sprung arms spaced from one another and extending away from said front panel and configured to slide into and engage opposite inner surfaces of a longitudinal channel defined by a length of a respective draw-out rail, at least one of said arms having a latching mechanism that is configured to snap into locking engagement with a corresponding structure on said draw-out rail to secure the supporting piece to the draw-out rail when said arms are fully inserted therein.

* * * * *